United States Patent [19]

Radel

[11] Patent Number: 4,945,522

[45] Date of Patent: Jul. 31, 1990

[54] TIME INDICATOR FOR A CLOCK OR WATCH

[76] Inventor: Winfried Radel, Strippchens Hof 7, 4330 Mulheim/Ruhr, Fed. Rep. of Germany

[21] Appl. No.: 203,474

[22] Filed: Jun. 6, 1988

[30] Foreign Application Priority Data

Jun. 6, 1987 [DE] Fed. Rep. of Germany ... 8708097[U]

[51] Int. Cl.[5] ..... G04B 19/20; G04B 19/06

[52] U.S. Cl. ..... 368/77; 368/233

[58] Field of Search ..... 368/76, 77, 80, 223, 368/228, 233–235

[56] References Cited

U.S. PATENT DOCUMENTS

| | | | |
|---|---|---|---|
| 1,496,348 | 6/1924 | McArthur | 368/233 |
| 2,011,517 | 8/1935 | Geoffrion | 368/233 |
| 2,202,581 | 5/1940 | Hammer | 368/233 |
| 2,266,183 | 12/1941 | Fergusson | 368/77 |
| 3,798,892 | 3/1974 | Lukens | 368/77 |

FOREIGN PATENT DOCUMENTS

| | | | |
|---|---|---|---|
| 4535872 | 2/1968 | Japan | 368/233 |

*Primary Examiner*—Vit W. Miska

*Attorney, Agent, or Firm*—Robert W. Becker

[57] ABSTRACT

A time indicator for a clock or watch that has a watch plate and at least two time-indicating elements that are at least partially superimposed over one another and are driven by centrally and coaxially disposed drive elements. The time-indicating elements are formed by disks or dials that are of the same or different sizes, rotate about centrally disposed shafts, and are disposed in different planes. To indicate time, the dials are provided with openings, indicators, or colors that cover or optically suppress all other information that at any given time is not necessary for reading off that time.

7 Claims, 2 Drawing Sheets

TIME INDICATOR FOR A CLOCK OR WATCH

BACKGROUND OF THE INVENTION

The present invention relates to a time indicator for a clock or watch that has a watch plate and at least two time-indicating elements that are at least partially superimposed over one another and are driven by centrally and coaxially disposed drive elements.

With conventional time-indicating devices, the time-indicating elements for indicating time in an analog fashion are generally formed by pointers or hands that move about a central axis over the watch plate, which is embodied as a number plate or dial. The indication of time with these conventional analog watches is based upon the fact that the hands indicate the hours, minutes, and seconds by their position, and with reference to the numbers on the dial, thus providing a characteristic for the analog reading. In so doing, there is provided, in comparison to a digital watch, the advantage that time intervals can be guessed at without, as with a digital watch, having to do calculations in order to be able to estimate or guess at time intervals for the future or the past.

However, with time-indicating devices that have hands, a relatively quick glance at the watch can lead to an erroneous reading, since with such a quick glance it is frequently not possible to differentiate which of the individual hands is the hour hand, the minute hand, or, if present, the second hand.

It is therefore an object of the present invention to provide a time indicator that is provided with time-indicating elements that rotate about a central axis, that offers the advantages of an analog reading, and that also essentially realizes the advantages of a digital watch, whereby a precise time reading is offered without further additional visual marks.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
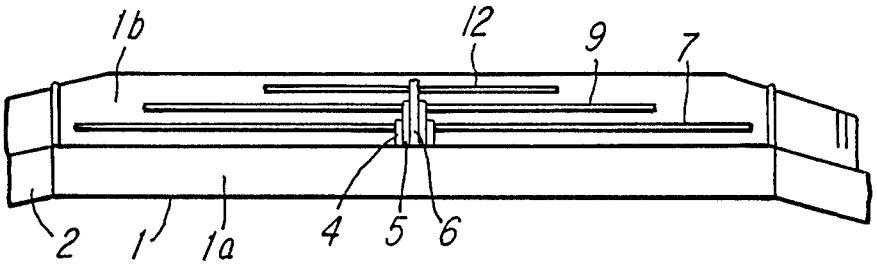
FIG. 1 is a cross-sectional view through a first exemplary embodiment of the inventive time indicator for a watch.

The time indicator of the present invention is characterized primarily in that the time-indicating elements are formed by disks or dials that are the same or different sizes, rotate about centrally disposed shaft means, and are disposed in different planes; to indicate time, for example the hours, minutes, and seconds, the dials are provided with means, such as openings, indicators, or colors, that cover or optically suppress all other information that at any given time is not necessary for reading off that time.

By covering those markings or similar information that is not used at any given time to read off that time, all of the visual features, as is the case with a digital watch, are concentrated upon the illustrated time, whereby simultaneously the advantage of an analog watch, namely being able to estimate time intervals and time periods, is maintained.

The "quasi-digitalization" of an analog watch via an optical limitation to the essential elements, facilitates reading off of the time, especially when it is possible to glance only very quickly at the watch.

Further specific features of the present invention will be described in detail subsequently.

DESCRIPTION OF THE PREFERRED EMBODIMENTS

Referring now to the drawings in detail, a watch housing 1 is secured, for example, to schematically illustrated carrying elements 2, such as straps. The housing or case 1 is divided by a watch plate 3 into two sections, namely a lower housing section 1*a* that accommodates the nonillustrated drive mechanism or gears, and an upper housing portion 1*b* in which are accommodated the time-indicating elements, which are in the form of rotating disks or dials 7, 9, and 12.

The lowermost dial 7 (the hour dial) is driven by the hollow or tubular shaft 4, the central dial 9 (the minute dial) is driven by the tubular shaft 5, and the uppermost dial 12 (the seconds dial) is driven by the central shaft 6. The individual shafts 4, 5, and 6 are disposed coaxial relative to one another, and the various dials 7, 9, and 12 are secured directly to their pertaining shafts.

In the vicinity of its outer rim, the hour dial 7 is provided with an opening 8 that makes it possible to see through to the surface, i.e. the watch plate 3, disposed therebelow. The minute dial 9 has an outer rim 10, which follows a spiral path, and also has an essentially radially extending rim portion 11 that connects the outer end of the spiral 10 with the inner end of the spiral 10.

The uppermost dial 12 is provided with a preferably radially extending marker or indicator 13.

Each dial has a different color than does the surface or dial disposed therebelow, and the dials are provided with respectively smaller dial surfaces when viewed from the bottom toward the top. It would also be possible to make the individual dials of different materials and to make the dials 7, 9, and 12 to be of same or different sizes.

Figure 2:
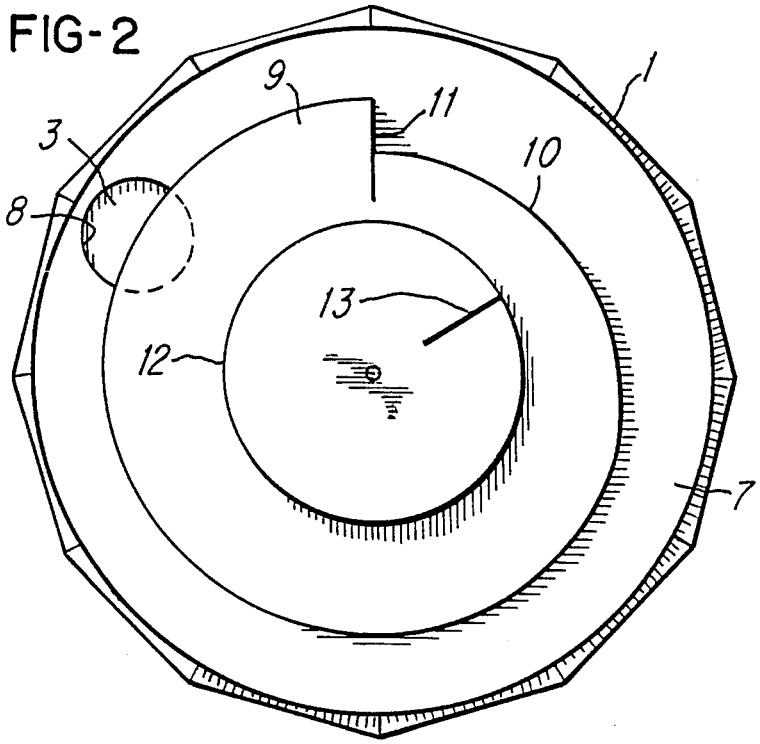
FIG. 2 is a plan view of the watch of FIG. 1.
Figure 3:
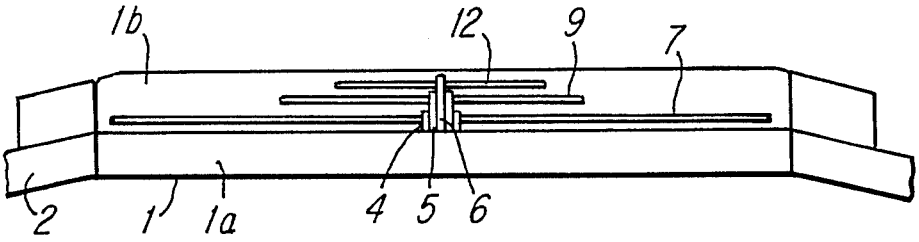
FIG. 3 is a cross-sectional view through a second exemplary embodiment of the inventive time indicator for a watch.

In the plan view of FIG. 2, the radial rim portion 11 of the minute dial 9 indicates a full hour, while the opening 8 in the hour dial 7 indicates, in conformity with a conventional watch, that the hour is 10.

The radial indicator or line 13 of the seconds dial 12 indicates that approximately 10 seconds past the hour have elapsed. In other words, the time indicator is indicating that the time is 10 o'clock, 0 minutes, and 10 seconds, i.e. 10:00:10.

Figure 4:
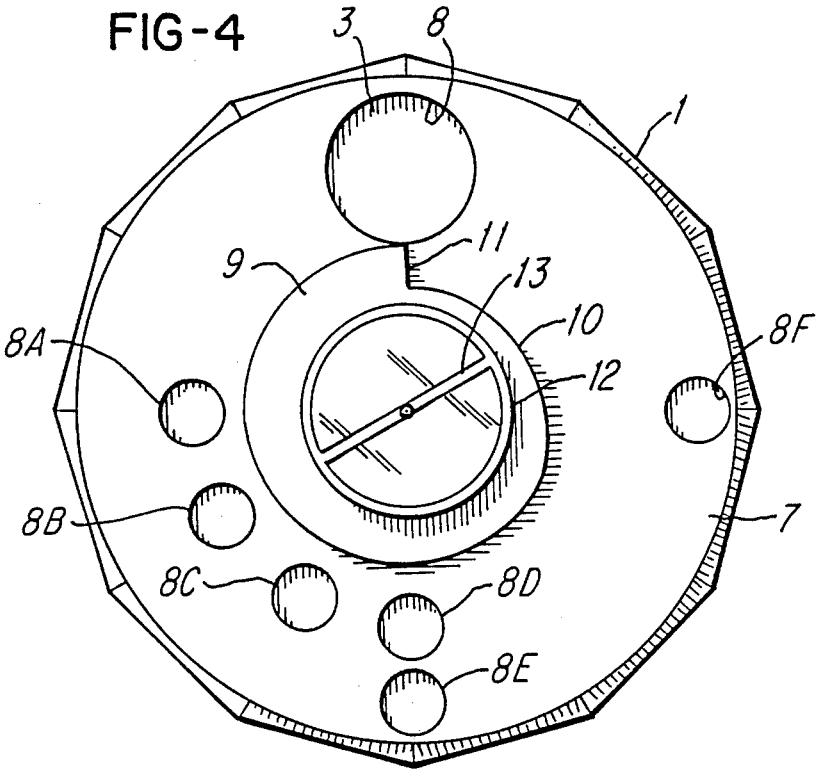
FIG. 4 is a plan view of the watch of FIG. 3.

In the embodiment of the inventive time indicator illustrated in FIG. 4, the first dial 7 is provided with openings 8, 8A, 8B, 8C, 8D, 8E, and 8F, with these openings being disposed on inner and outer circular rings. Analogous to the time zones of the earth, the openings are undertaken in an annular disposition. In so doing, the hours 0 to 12 can be represented on an outer ring, and the hours 13 to 24 can be represented on an inner ring.

The indication possibilities 8A–8F represent a synchronous world time indication, which can always be undertaken relative to the time indicated in the opening 8, such as eastern standard time. The number of and which time zones are to be represented can be established at the time the dial 7 is manufactured.

Pursuant to a modified inventive embodiment, it is possible, for example, to replace the seconds dial 12 with a dial having a concentric ring that, as an indicator, is provided with a discontinuity, for example in the form of a radial slot, whereby this seconds dial, with the exception of the ring, is transparent, if the ring of this dial is disposed beyond this surface of the minute dial 9 that is disposed therebelow. Also it is possible for a surface below the first dial 7 to be that of another one of the dials.

The novel time indicator offers considerably greater latitude in the freedom of design than do the conventional analog watches. Not only the dials but also the watch plate can be part of this design. There are numerous possibilities for representing identification features or other decorations by way of the superimposed dials. The rotating dials permit opalescence and completely new visual effects. Thus, in addition to providing a better and more precise reading of the time, the novel time indicators reinforce the trend of using a watch for identification features for very different goals.

The present invention is, of course, in no way restricted to the specific disclosure of the specification and drawings, but also encompasses any modifications within the scope of the appended claims.

What I claim is:

1. In a time indicator for a watch that has a watch plate and at least two time-indicating elements that are at least partially superimposed over one another, that are driven by centrally and coaxially disposed drive elements, that provide advantages of an analog reading and that also essentially realize advantages of a digital watch so that a precise time reading is offered without further additional visual marks, the improvement therewith which comprises:

said time-indicating elements being formed by dials that are disposed in different planes and rotate about centrally disposed shaft means as said drive elements; to indicate time, at least one dial being provided with means that cover or optically suppress all other information that at any given time is not necessary for reading off that time;

said dials being different sizes;

the sizes of said dials progressively decrease in dial surfacing from the bottom toward the top in a mounted arrangement thereof on said centrally disposed shaft means; and a first dial, which is provided with said means, to indicate the time, in the form of opening means, and also a second dial, which is provided with an outer rim that follows a spiral path, and is also provided with an essentially radially extending rim portion that connects an outwardly disposed end of said spiral path with an inwardly disposed end of said spiral path.

2. A time indicator according to claim 1, which includes a third dial that is provided with a preferably radially extending marking.

3. A time indicator according to claim 1, which includes a third dial that has a concentric ring that is provided with a marking in the form of a discontinuity.

4. A time indicator according to claim 3, in which said discontinuity is in the form of a radial slot.

5. A time indicator according to claim 3, in which, with the exception of said ring, said third dial is transparent.

6. A time indicator according to claim 5, in which said third dial is the uppermost dial, with said ring of said third dial being disposed beyond the surface of the dial disposed therebelow.

7. A time indicator according to claim 1, in which each of said dials has a color different than the color of the dial disposed below it.

* * * * *